US006752883B2

(12) United States Patent
Ishida et al.

(10) Patent No.: US 6,752,883 B2
(45) Date of Patent: Jun. 22, 2004

(54) FREE-CUTTING NI-BASE HEAT-RESISTANT ALLOY

(75) Inventors: Kiyohito Ishida, 5-20, Kamisugi 3-chome, Aoba-ku, Sendai-shi, Miyagi (JP); Katsunari Oikawa, Miyagi (JP); Shigeki Ueta, Nagoya (JP); Toshiharu Noda, Nagoya (JP); Takashi Ebata, Miyagi (JP)

(73) Assignees: Kiyohito Ishida, Sendai-shi (JP); Dokuritsu Gyousei Houjin Sangyo Gijutsu Sougo Kenkyusho, Tokyo (JP); Daido Tokushuko Kabushiki Kaisha, Nagoya (JP); Tohoku Tokushuko Kabushiki Kaisha, Shibata-gun (JP)

( * ) Notice: Subject to any disclaimer, the term of this patent is extended or adjusted under 35 U.S.C. 154(b) by 62 days.

(21) Appl. No.: 10/158,167

(22) Filed: May 31, 2002

(65) Prior Publication Data

US 2002/0195175 A1 Dec. 26, 2002

(30) Foreign Application Priority Data

Jun. 4, 2001 (JP) ..... 2001-167940

(51) Int. Cl.[7] ..... C22C 19/05

(52) U.S. Cl. ..... 148/428; 148/427; 420/445; 420/446; 420/447; 420/448; 420/449; 420/450; 420/451; 420/452; 420/453; 420/454

(58) Field of Search ..... 148/427, 428; 420/442, 443, 444, 445, 446, 447, 448, 449, 450; 426/451–454

(56) References Cited

FOREIGN PATENT DOCUMENTS

| | | | | |
|---|---|---|---|---|
| DE | 44 36 670 A1 | | 5/1995 | |
| EP | 1 085 105 A2 | | 3/2001 | |
| JP | 53 026220 | | 3/1978 | |
| JP | 56-105448 | * | 8/1981 | ..... 420/443 |
| JP | 04246155 | | 9/1992 | |

OTHER PUBLICATIONS

ASM Handbook, (Formerly Tenth Edition, Metals Handbook), vol. 2 1990, p. 436.*

* cited by examiner

*Primary Examiner*—John P. Sheehan

(57) ABSTRACT

A free-cutting Ni-base heat-resistant alloy excellent in the high-temperature strength and corrosion resistance was proposed. The alloy contains Ni as a major component, 0.01 to 0.3 wt % of C and 14 to 35 wt % of Cr, and further contains at least one element selected from Ti, Zr and Hf in a total amount of 0.1 to 6 wt %, and S in an amount of 0.015 to 0.5 wt %. The alloy has dispersed in the matrix thereof a machinability improving compound phase, where such phase contains any one of Ti, Zr and Hf as a major constituent of the metal elements, essentially contains C and either S or Se as a binding component for such metal elements. The alloy also satisfies the relations of $W_{Ti}+0.53W_{Zr}+0.27W_{Hf}>2W_C+0.75W_S$ and $W_C>0.37W_S$, where $W_{Ti}$ represents Ti content (wt %), $W_{Zr}$ represents Zr content (wt %), $W_{Hf}$ represents Hf content (wt %), $W_C$ represents C content (wt %) and $W_S$ represents S content (wt %). This successfully suppresses the amount of free S residing in the alloy, which results in an improved machinability while preventing the hot workability from being degraded.

10 Claims, No Drawings

FREE-CUTTING NI-BASE HEAT-RESISTANT ALLOY

RELATED APPLICATION

This application claims the priority of Japanese Patent Application NO. 2001-167940 filed on Jun. 4, 2001 which is incorporated herein by reference.

FIELD OF THE INVENTION

The present invention relates to a free-cutting Ni-base heat-resistant alloy having an excellent machinability.

BACKGROUND OF THE INVENTION

An excellent high temperature strength is demanded for exhaust valves and bolts for engines since they are used under high temperature environment. There is an additional demand of corrosion resistance against exhaust gas for exhaust pipes and valves in chemical plants as well as the demand of high temperature strength. It has thus been a general practice to use, as a structural material for composing such parts, nickel (Ni)-base heat-resistant alloys excellent in strength and corrosion resistance in high temperature ranges.

A problem of poor machinability has, however, resided in the conventional Ni-base heat-resistant alloy, although being excellent in the strength and corrosion resistance. Structural steel or stainless steel will successfully be improved in the machinability by being added with so-called machinability improving elements such as Pb, Bi, S, Se or Te, but the Ni-base heat-resistant alloy will considerably be ruined in the hot workability by containing such machinability improving elements. So that almost no approach has been made for Ni-base heat-resistant alloy to intentionally improve the machinability, which has inevitably pushed up machining costs of such material in the product making.

It is therefore an object of the present invention to provide a free-cutting Ni-base heat-resistant alloys excellent in strength and corrosion resistance in high temperature ranges and in machinability.

SUMMARY OF THE INVENTION

To solve the foregoing problems, a free-cutting Ni-base heat-resistant alloy of the present invention contains Ni as a major component;

contains C in an amount of 0.01 to 0.3 wt % and Cr in an amount of 14 to 35 wt %;

contains at least one element selected from Ti, Zr and Hf in a total amount of 0.1 to 6 wt %, and S in an amount of 0.015 to 0.5 wt %;

has dispersed in the matrix thereof a machinability improving compound phase, where such phase contains any one of Ti, Zr and Hf as a major constituent of the metal elements, essentially contains C and either S or Se as a binding component for such metal elements; and satisfies the relations of:

$$W_{Ti}+0.53W_{Zr}+0.27W_{Hf}>2W_C+0.75W_S; \text{ and}$$

$$W_C>0.37W_S$$

where $W_{Ti}$ represents Ti content (wt %), $W_{Zr}$ represents Zr content (wt %), $W_{Hf}$ represents Hf content (wt %), $W_C$ represents C content (wt %) and $W_S$ represents S content (wt %).

It is to be noted that "major component" in the context of this specification means a component having a largest content on the weight basis in a target texture (the same will apply to other expressions such as "mainly" or "mainly comprises").

By containing at least one of Ti, Zr and Hf, together with C, and also with either S or Se, the Ni-base heat-resistant alloy will have generated in the matrix thereof a compound (machinability improving compound phase) based on such composition. The present inventors found that the Ni-base heat-resistant alloy was significantly improved in the machinability by having generated in the matrix thereof such machinability improving compound phase, which led us to propose the present invention.

A reason why the machinability of the Ni-base heat-resistant alloy can be improved by the formation of such machinability improving compound phase is supposed as follows. That is, when the alloy is subjected to processing such as cutting or grinding in order to remove a portion thereof, the machinability improving compound phase finely dispersed in the matrix can act just like a perforation to thereby facilitate formation of the sectional plane, which is supposed as being responsible for the improved machinability. Any way, the machinability improving compound phase can be responsible for a machinability equivalent to or superior to that attainable by the foregoing machinability improving elements which have previously been used, while successfully avoiding degradation of other characteristics inherent to the heat-resistant alloy and retaining a good hot workability.

In the conventional Ni-base heat-resistant alloy, it has been considered as necessary to intentionally control the content of sulfur (S) in order to keep a good hot workability, and in some cases even an effort has been made to use a high-purity Ni material containing almost no S. On the contrary in the present invention, such S content will be in an allowable range since the S will be incorporated into such machinability improving compound phase as one constituent thereof. So that S contained in the Ni-base heat-resistant alloy of the present invention will not heavily affect the hot workability of the alloy. This makes it possible to use a source material containing a relatively large amount of S, which is expected to result in an improved productivity.

A reason why the hot workability of the conventional Ni-base heat-resistant alloy degraded due to the addition of S can be explained by the formation of (Ni, S) compound, in particular $Ni_3S_2$ in the alloy. In the present invention, S contained in the alloy is incorporated into the machinability improving compound phase during the growth thereof, which suppresses the formation of $Ni_3S_2$ and thus successfully prevent the hot workability from being degraded for its S content.

Another advantage of the formation of the machinability improving compound phase relates to that it hardly affects the strength and corrosion resistance at high temperature ranges, which are properties most critical for the Ni-base heat-resistant alloy. In this case, properties such as strength and corrosion resistance at high temperature ranges are defined by residual constituents in the matrix other than such machinability improving compound phase. So that the heat-resistant alloy will be obtained with desired properties by properly adjusting the composition of the matrix other than the machinability improving compound phase.

In the Ni-base heat-resistant alloy of the present invention, the machinability improving compound phase can be generated so as to be dispersed within the matrix. In particular, finer dispersion of such compound phase within the matrix will result in better machinability of the Ni-base heat-resistant alloy. In order to raise the improving effect of the machinability, it is preferable to control an average size of the machinability improving compound phase observed in the polished sectional microstructure of the Ni-base heat-resistant alloy (maximum width between two parallel tangential lines which are drawn in some different directions so as to circumscribe the outer contour of the compound grain) within a range from 1 to 5 $\mu$m or around.

An area ratio of the machinability improving compound phase observed in a polished surface of the material is preferably 0.1 to 10%. For the purpose of obtaining improving effect of the machinability by forming such machinability improving compound phase, such phase must be contained in an amount of 0.1% or more in terms of an area ratio in the polished sectional microstructure. Excessively large area ratio will however be no more effective due to saturation of such effect, or may rather adversely affect other characteristics inherent to the heat-resistant alloy (i.e., strength and corrosion resistance at high temperature ranges). So that the area ratio in the polished sectional microstructure of the Ni-base heat-resistant alloy is preferably set to 10% or below.

The machinability improving compound phase can typically be such that mainly comprising a compound expressed by a composition formula $M_4Q_2C_2$ (where M represents the metal element containing any one of Ti, Zr and Hf as a major constituent, and Q represents either S or Se) It is to be noted now that in this specification the compound expressed by such formula may occasionally be abbreviated as "TICS". The compound has a good dispersion property into the matrix, and is particularly excellent in raising the machinability.

As for the component M in the compound, it is more preferable that Ti is essentially contained, where Zr and/or Hf may optionally be contained. In the case that V, Nb or Ta is contained in the Ni-base heat-resistant alloy, at least a part of which may compose such component M. As for the component Q, it is more preferable that S is essentially contained, where Se may be contained so as to substitute for a part of S. Both components M and Q are not precluded from containing any other components than described in the above as subsidiary components in order to obtain the effect of the present invention as far as properties to be possessed by the machinability improving compound phase (improving machinability and good dispersion property) are not ruined. The machinability improving compound phase including V, Nb, Ta or so may possibly improve the strength of such compound.

The $M_4Q_2C_2$-base compound in the Ni-base heat-resistant alloy can be identified by X-ray diffractometry and electron probe X-ray micro-analysis (EPMA). For example, presence or absence of the $M_4Q_2C_2$-base compound can be confirmed based on presence or absence of the correspondent peak ascribable to such compound in a measured profile obtained by the X-ray diffractometry. An area where the compound is formed in the alloy can be specified by subjecting the sectional microstructure of the alloy to surface analysis based on EPMA, and then comparing two-dimensional mapping results of characteristic X-ray intensity ascribable to Ti, Zr, Hf, S, Se or C.

Next paragraphs will describe causes for specifying ranges of contents of the individual components in the Ni-base heat-resistant alloy of the present invention.

(1) Ni: contained as a major component

Ni is an essential component for composing the Ni-base heat-resistant alloy of the present invention, so that it is contained as a major component. Considering the balance with other essential additional element components, the upper limit of the content thereof is set to 85 wt %. Ni content does not exceed 85 wt % also in the most of generally available Ni-base heat-resistant alloys, since the content exceeding 85 wt % may sometimes fail in fully demonstrating the properties specific to heat-resistant alloys due to relative shortage of contents of the residual components. So that the Ni content is preferably 85 wt % at most, and more preferably 50 to 80 wt %.

(2) C: 0.01 to 0.3 wt %

C is an essential element for improving the machinability in the present invention. C, in coexistence with (Ti, Zr, Hr) or S described later, can form the machinability improving compound phase. The content of C less than 0.01 wt % will be too short to form the machinability improving compound phase in an amount enough for markedly improving the machinability. On the contrary, the content exceeding 0.3 wt % will increase a portion of C not contributive to the formation of the machinability improving compound phase, which will result in excessive production of other carbides and carbo-sulfides. Excessive production of such carbides and carbo-sulfides is undesirable since they are causative of degraded hot workability and ductility. The C content is more preferably 0.03 to 0.2 wt %.

Cr: 14 to 35 wt %

Cr is an important element for ensuring corrosion resistance and oxidation resistance of the Ni-base heat-resistant alloy. Efficient achievement of such effects will be ensured in a content of 14 wt % or more. The content exceeding 35 wt % will however ruin the phase stability, which results in lowered toughness and degraded anti-oxidative property. The Cr content is more preferably set within a range from 16 to 30 wt %, and still more preferably from 18 to 25 wt %.

(4) At least one of (Ti, Zr, Hf) in a total amount of 0.1 to 6 wt %

Ti, Zr or Hf is an essential component element of the machinability improving compound phase which plays a principal role in exhibiting improving effect of the machinability of the free-cutting Ni-base heat-resistant alloy of the present invention. The total content of at least one of these elements of less than 0.1 wt % will result in an insufficient amount of production of the machinability improving compound phase, so that a sufficient improving effect of the machinability cannot be expected. On the contrary, when the total amount is excessive, (Ti, Zr, Hf) may form compounds with other elements to thereby lower the machinability. So that the total content of these elements is necessarily suppressed to 6 wt % or less. A part of (Ti, Zr, Hf) as the metal component elements composing the machinability improving compound phase may be substituted by Nb or Ta, which elements can contribute to the formation of $\gamma'$ phase to thereby improve the high-temperature strength of the Ni-base heat-resistant alloys. Zr and Hf are not so much effective in improving the machinability and high-temperature strength as compared with Ti, so that of these elements, it is more preferable to employ Ti as a major component. In this case the Ti content is preferably set within a range from 0.1 to 4 wt % in order to efficiently obtain such effect. Although Zr and Hf are not so effective as Ti in improving the machinability and high-temperature strength of the alloy, they are advantageous in raising the grain boundary strength through segregation within the grain boundary, so that they may be contained to an extent not causative of attenuating the Ti-related benefit. It is to be noted that composing the metal component of the machinability improving compound phase only with Zr and/or Hf can also be effective in improving the machinability and high-temperature strength.

(5) S: 0.015 to 0.5 wt %

S is an effective element for improving the machinability. By containing S, compounds effective for raising the machinability (e.g., the foregoing machinability improving compound phase) can be formed within the alloy texture. So that the lower limit of the S content is defined as 0.015 wt %. Excessive addition of Swill however increase a portion of S not involved in the formation of the machinability improving compound phase (referred to as "free S"), which eventually promote the formation of (Ni, S) compounds, in particular $Ni_3S_2$ causative of degrading the hot workability. While the amount of formation of the machinability improving compound phase increases with the S content, excessive formation thereof will degrade properties specific to the heat-resistant alloy. So that the upper limit of the S content is defined as 0.5 wt %. To obtain the improving effect of the machinability by such compound to a desirable degree, it is preferable to properly adjust the S content according to the amount of addition of other constituents of the machinability improving compound phase such as C, Ti, Zr, Hf or so. The free S is preferably as less as possible, and it is desirable to adjust the S content so that almost all portion of S added to the Ni-base heat-resistant alloy will compose the machinability improving compound phase.

The component Q other than S (which herein means Se) may be included in the machinability improving compound phase so as to A substitute for S composing such phase. In this case, the Se content is preferably set within a range from 0.0005 to 0.1 wt %. The content less than 0.0005 wt % will be meaningless since the effect of the addition will hardly become clear. On the other hand, the content exceeding 0.1 wt % may sometimes degrade the hot workability and other properties specific to the heat-resistant alloy.

(6) Satisfying relations of:

$$W_{Ti}+0.53W_{Zr}+0.27W_{Hf}>2W_C+0.75W_S \quad \text{formula A}$$

and $$W_C>0.37W_S \quad \text{formula B}$$

where $W_{Ti}$ represents Ti content (wt %), $W_{Zr}$ represents Zr content (wt %), $W_{Hf}$ represents Hf content (wt %), $W_C$ represents C content (wt %) and $W_S$ represents S content (wt %).

The left side of the formula A represents a parameter reflecting the total number of (Ti, Zr, Hf) atoms. That is, the foregoing machinability improving effect by the machinability improving compound phase is determined based on the total number of atoms (or the molar number), not on the total weight of the constituents to be included. Also the right side of the formula A represents a parameter reflecting the total number of (C, S) atoms. Coefficients for $W_{Ti}$, $W_{Zr}$ and $W_{Hf}$ appear on the left side of the formula A are determined based on a fact that ratio of the number of (Ti, Zr, Hf) atoms per unit weight of the alloy is found to be 1:0.53:0.27, and similarly, coefficients for $W_C$ and $W_S$ appear on the right side of the formula A are determined based on a fact that ratio of the number of (C, S) atoms per unit weight of the alloy is found to be 2:0.75. So that it is to be understood that the formula A is such that comparing the total numbers of (Ti, Zr, Hf) atoms and (C, S) atoms. Similarly, the formula B can be understood as a formula for comparing the numbers of C and S atoms contained in the alloy.

Assuming that all parts of (Ti, Zr, Hf, C, S) atoms added to the alloy are to be involved for the formation of TICS expressed by formula $M_4Q_2C_2$, satisfying the above formula A expressing (left side)>(right side) will inevitably mean that a portion of (Ti, Zr, Hf) atoms not contributing to the formation of TICS can remain in the residual alloy part. Such portions of (Ti, Zr, Hf) will however hardly affect the properties of the heat-resistant alloy even they remain in the residual alloy part to some extent, or rather, they may compose the γ' phase to thereby raise the strength. On the contrary in the case of (left side)<(right side), a portion of at least either of (C, S) atoms will never contribute to the formation of TICS and remain in the residual alloy part in a free form. Free S remaining in the residual alloy part is undesirable since it may react with Ni to thereby form (Ni, S) compound, in particular $Ni_3S_2$, causative of degrading the hot workability. On the other hand, C which is present in the residual alloy part other than the machinability improving compound phase may degrade the machinability or properties specific to the heat-resistant alloy due to promoted formation of carbides other than such machinability improving compound. Thus the formula A is necessarily be satisfied.

Further satisfying herein the formula B ensures that the number of S atoms to be contained is smaller than that of C. This ensures that S to be contained will almost completely be fixed to the machinability improving compound phase, and will suppress the content of free S residing in the matrix other than such machinability improving compound phase. A portion of C not involved in the formation of the machinability improving compound phase may sometimes result in the formation of carbides responsible for raising the creep strength. This is why the formula B is defined at least as (left side)>(right side). However as has been described in the above, excessive free C may degrade the machinability or other properties of the alloy, so that it is more preferable to satisfy the following formula:

$$0.37W_S+0.1>W_C \quad \text{formula B'}$$

in order to suppress the excessive free C.

In the free-cutting Ni-base heat-resistant alloy of the present invention, the Si content is preferably set to 4 wt % or less, and Mn to 1 wt % or less.

(7) Si : 4 wt % or less

Si is inevitably contained in the alloy as a deoxidizing element. Intentional addition thereof to a certain extent will be also allowable since the element has an improving effect of the oxidation resistance of the Ni-base heat-resistant alloy. To obtain the oxidation resistance to a sufficient degree, the addition in an amount of at least 0.1 wt % is recommendable. It is also recommendable to suppress the content to 4 wt % or less since excessive content thereof will degrade the hot workability and ductility.

Mn: 1 wt % or less

Mn is inevitably contained in the alloy as a deoxidizing element. Excessive content thereof however is not desirable since it may not only degrade the corrosion resistance but also promote the deposition of $Ni_3Ti$ which is a phase responsible for embrittlement. So that the content thereof is preferably suppressed to 1 wt % or less.

The alloy of the present invention may further contain 0.1 to 5 wt % of Al in order to improve the high-temperature strength and corrosion resistance.

(9) Al: 0.1 to 5 wt %

In the Ni-base heat-resistant alloy, Al is responsible for solid solution hardening by forming solid solution in the matrix thereof, or for precipitation hardening of γ' phase by forming γ' phase ($Ni_3Al$) by reacting with the Ni component. Al which can form solid solution in the alloy is also expectable for its effect of improving the oxidation resistance at high temperature ranges. The high-temperature strength of the Ni-base heat-resistant alloy is often largely contributed especially by precipitation hardening of such γ' phase formation. So that the Al content within the above range is preferable in view of obtaining desirable properties specific to the heat-resistant alloy. Al content of less than 0.1 wt % results in the foregoing effect only to an insufficient degree. On the other hand, the content exceeding 5 wt % will inhibit the hot working, so that the Al content is more preferably set within a range from 0.2 to 3 wt %.

The Ni-base heat-resistant alloy of the present invention can contain at least any one of 0.1 to 20 wt % of Co, 0.1 to 20 wt % of Mo and 0.1 to 20 wt % of W.

(10) Co: 0.1 to 20 wt %

Similarly to Ni, Co can stabilize the austenitic phase, and increases the amount of formation of the γ' phase, which is a precipitation hardening phase, to thereby improve the strength of the alloy. Co may sometimes improve the high-temperature strength of the alloy by forming solid solution in the Ni component. To obtain the effect of addition to a desirable degree, the Co content is preferably set to 0.1 wt % or above. On the other hand, the addition exceeding 20 wt % is no more desirable since the effect of solid solution hardening will saturate, and the cost will increase.

(11) Mo: 0.1 to 20 wt %; W: 0.1 to 20 wt %

Mo and W are responsible for improving high-temperature strength of the alloy by forming solid solution in the texture thereof, and for improving corrosion resistance based on passivation enhancement. The contents less than 0.1 wt % will fail in obtaining a sufficient effect, and on the contrary exceeding 20 wt % will undesirably ruin the hot workability of the alloy.

It is further preferable in the present invention to suppress the Fe content to 20 wt % or less. Fe is often used as the basic component of the Ni-base heat-resistant alloy as well as Ni and Cr, but this is largely because Fe is relatively easy to handle and inexpensive. Increasing the Fe content while making a great account of cost has however degraded the corrosion resistance of the Ni-base heat-resistant alloy due to relative decrease in the Ni and Cr contents. So that for the applications in which the corrosion resistance is of a great importance, the Fe content is preferably suppressed to 20 wt % or less. Further, the Fe content is preferably suppressed to 10 wt % or less and more preferably 5 wt % or less.

The Ni-base heat-resistant alloy of the present invention may also contain 0.1 to 5 wt % of Cu. Cu is advantageous in improving the corrosion resistance, in particular that in the reductive acidic environment (in particular sulfuric acid environment), and also in reducing the work hardening property to thereby improve the workability. Cu can also be added in order to improve the antibacterial property, which can be enhanced by annealing. The Cu content is necessarily set to 0.1 wt % or above to ensure such effects. The excessive addition however degrades the hot workability, so that the content is preferably set within a range of 5 wt % or below.

The Ni-base heat-resistant alloy of the present invention may also contain Nb and Ta in a total amount of 0.1 to 7 wt %. Such components added to the alloy will form solid solution in the γ' phase ($Ni_3Al$) formed in the texture of the Ni-base heat-resistant alloy, to thereby raise the strength of such γ' phase ($Ni_3Al$), and thus raise the high-temperature strength of the entire alloy. Such components can also be included in the foregoing machinability improving compound phase to thereby increase the strength thereof. To obtain such effect to a desirable extent, the total content thereof is preferably set to 0.1 wt % or above. On the contrary, the content exceeding 7 wt % will undesirably degrade the toughness. More preferable total amount of Nb and Ta resides within a range from 0.5 to 5 wt %.

The Ni-base heat-resistant alloy of the present invention may also contain 0.0005 to 0.01 wt % of B. B is a valuable element for improving the hot workability. The content less than 0.0005 wt % will result in only a limited range of effects, and exceeding 0.01 wt % will degrade the hot workability.

Specific examples of materials applicable to the Ni-base heat-resistant alloy of the present invention will be listed below (all in trade names). It is to be defined that the alloy compositions thereof are such that containing machinability improving elements (Ti, Zr, Hf, S, Se, C, etc.) specified in the present invention so as to substitute for a part of Ni as a major component. So that, the names listed below mean specific alloys of the present invention derived from the alloys whose composition are specified by the product standard, although the product names were quoted herein for convenience. Individual alloy compositions of the original products are described in "Kinzoku Deta Bukku (Metal Data Book), 3rd edition.", p. 138, published by Maruzen, and will not be detailed in this specification.

(1) Solution-hardened Ni-base heat-resistant alloy: Hastelloy-C22, Hastelloy-C276, Hastelloy-G30, Hastelloy X, Inconel 600 and KSN.

(2) Precipitation-hardening Ni-base heat-resistant alloy: Astroloy, Cabot 214, D-979, Hastelloy S, Hastelloy XR, Haynes 230, Inconel 587, Inconel 597, Inconel 601, Inconel 617, Inconel 625, Inconel 706, Inconel 718, Inconel X750, M-252, Nimonic 75, Nimonic 80A, Nimonic 90, Nimonic 105, Nimonic 115, Nimonic 263, Nimonic PE.11, Nimonic PE.16, Nimonic PK.33, Rene 41, Rene 95, SSS 113MA, Udimet 400, Udimet 500, Udimet 520, Udimet 630, Udiment 700, Udimet 710, Udimet 720, Unitemp AF 2-1 DA 6 and Waspaloy.

DETAILED DESCRIPTION OF THE PREFERRED EMBODIMENTS

EXAMPLES

The following experiments were carried out to investigate the effects of the present invention.

The individual alloys of the present invention and comparative alloys respectively having compositions listed in Tables 1 and 2 were melted in a vacuum induction heater to thereby obtain 50-kg alloy ingots. The ingots were then kept at 1,200° C. for homogenization, and were then processed by hot forging within a temperature range from 1,200 to 1,000° C. to thereby obtain round rods of 65 mm in diameter. A part of such rods was further forged to reduce the diameter to as small as 20 mm. The rods were then subjected to solution heat treatment at 1,100° C. for 1 hour, and then successively to age hardening at 700° C. for 16 hours. The 65-mm-diameter rods were subjected to machinability evaluation, and the 20-mm-diameter rods were subjected to evaluation of hot workability, hardness after aging and creep characteristics.

TABLE 1

| | No. | C | Si | Mn | S | Se | Cr | Ti | Zr | Hf | M | Al | Co | Mo | W | Fe | Cu | Nb + Ta | B |
|---|---|---|---|---|---|---|---|---|---|---|---|---|---|---|---|---|---|---|---|
| Example | 1 | 0.03 | 0.16 | 0.12 | 0.030 | — | 19.2 | 2.53 | 0.12 | — | 2.65 | 1.58 | — | — | — | — | — | — | — |
| | 2 | 0.08 | 0.72 | 0.14 | 0.043 | — | 32.4 | 0.27 | — | 0.20 | 0.27 | 2.16 | — | — | — | — | — | 2.2 | — |
| | 3 | 0.06 | 0.22 | 0.08 | 0.098 | — | 22.4 | 0.56 | — | — | 0.56 | 0.12 | — | 15.3 | — | 2.2 | 0.3 | 3.8 | — |
| | 4 | 0.11 | 0.35 | 0.29 | 0.102 | — | 19.8 | 2.64 | 0.09 | — | 2.73 | 1.40 | 15.5 | — | — | — | — | — | 0.003 |
| | 5 | 0.19 | 3.32 | 0.56 | 0.307 | — | 28.3 | 0.72 | 0.00 | — | 0.72 | 1.98 | — | — | 15.2 | 1.8 | — | — | — |
| | 6 | 0.22 | 0.14 | 0.16 | 0.419 | — | 23.5 | 3.16 | — | — | 3.16 | 1.58 | — | 3.4 | 1.5 | — | — | — | — |
| | 7 | 0.09 | 0.50 | 0.53 | 0.216 | — | 18.4 | 2.69 | 0.15 | 0.07 | 2.84 | 1.69 | — | 2.6 | — | 16.2 | — | — | — |
| | 8 | 0.14 | 0.82 | 0.51 | 0.163 | — | 21.0 | 2.35 | — | — | 2.35 | 0.89 | — | — | — | 5.6 | 0.23 | 1.7 | 0.006 |
| | 9 | 0.06 | 0.34 | 0.19 | 0.087 | 0.01 | 14.3 | 2.12 | 0.20 | — | 2.32 | 1.14 | 5.7 | 2.3 | — | — | — | 0.5 | — |
| | 10 | 0.05 | 0.49 | 0.27 | 0.114 | — | 25.1 | 2.81 | — | — | 2.81 | 1.39 | — | — | 2.7 | 3.4 | 3.8 | — | — |
| | 11 | 0.1 | 0.11 | 0.07 | 0.061 | — | 14.6 | 1.98 | — | — | 1.98 | 4.35 | — | 4 | — | — | — | — | — |
| Compara- | 12 | 0.04 | 0.23 | 0.20 | 0.001 | — | 20.6 | 2.51 | 0.09 | — | 2.6 | 1.55 | — | — | — | — | — | — | — |
| tive | 13 | 0.07 | 0.69 | 0.12 | 0.005 | — | 31.8 | 0.26 | — | 0.22 | 0.26 | 2.16 | — | — | — | — | — | 2.1 | — |
| Example | 14 | 0.02 | 0.22 | 0.10 | 0.530 | — | 22.4 | 0.55 | — | — | 0.55 | 0.13 | — | 15.4 | 0 | 1.9 | 0.5 | 3.9 | — |
| | 15 | 0.35 | 0.32 | 0.31 | 0.024 | — | 20.2 | 2.67 | 0.12 | — | 2.79 | 1.43 | 15.2 | — | — | — | — | — | 0.002 |
| | 16 | 0.01 | 0.19 | 0.22 | 0.055 | — | 25.9 | 2.3 | 0.14 | — | 2.44 | 1.57 | — | 1.8 | — | 5.3 | — | — | 0.003 |
| | 17 | 0.42 | 3.26 | 0.55 | 0.771 | — | 31.9 | 0.69 | — | — | 0.69 | 1.92 | — | — | 15.4 | 1.6 | — | — | — |
| | 18 | 0.03 | 0.23 | 0.26 | 0.111 | — | 20.5 | 0.07 | — | — | 0.07 | 2.89 | 8.7 | 5.2 | — | 0.4 | — | — | — |
| | 19 | 0.14 | 0.07 | 0.09 | 0.169 | — | 24.8 | 5.33 | 0.5 | 0.41 | 6.24 | 1.65 | — | — | — | — | — | 0.8 | 0.003 |
| | 20 | 0.05 | 0.15 | 0.18 | 0.073 | — | 11.7 | 2.73 | — | — | 2.73 | 1.6 | 10.4 | — | — | — | — | 1.2 | — |
| | 21 | 0.06 | 0.11 | 0.08 | 0.095 | — | 38.6 | 2.67 | — | — | 2.67 | 1.44 | — | 1.9 | — | — | — | — | — |
| | 22 | 0.13 | 6.78 | 0.19 | 0.123 | — | 27.2 | 2.84 | 0.07 | — | 2.91 | 1.34 | — | — | — | 0.8 | — | — | — |
| | 23 | 0.16 | 0.14 | 3.77 | 0.216 | — | 21 | 3.22 | — | 0.13 | 3.35 | 1.51 | — | 3.3 | 1.2 | — | — | — | 0.005 |
| | 24 | 0.21 | 0.12 | 0.34 | 0.398 | — | 18.8 | 3.14 | — | — | 3.14 | 0.8 | — | — | — | — | — | — | — |
| | 25 | 0.06 | 0.14 | 0.12 | 0.047 | — | 20.3 | 2.85 | — | — | 2.85 | 2.62 | — | — | — | — | — | — | 0.002 |

TABLE 2

| | No. | Ti + 0.53 Zr + 0.27 Hf | 2C + 0.75S | Formula A | 0.37S | Formula B | Formula B' | |
|---|---|---|---|---|---|---|---|---|
| Example | 1 | 2.59 | 0.08 | ○ | 0.01 | ○ | ○ | |
| | 2 | 0.32 | 0.19 | ○ | 0.02 | ○ | ○ | |
| | 3 | 0.56 | 0.19 | ○ | 0.04 | ○ | ○ | |
| | 4 | 2.69 | 0.30 | ○ | 0.04 | ○ | ○ | |
| | 5 | 0.72 | 0.61 | ○ | 0.11 | ○ | ○ | |
| | 6 | 3.16 | 0.75 | ○ | 0.16 | ○ | ○ | |
| | 7 | 2.79 | 0.34 | ○ | 0.08 | ○ | ○ | |
| | 8 | 2.35 | 0.40 | ○ | 0.06 | ○ | ○ | |
| | 9 | 2.23 | 0.19 | ○ | 0.03 | ○ | ○ | |
| | 10 | 2.81 | 0.19 | ○ | 0.04 | ○ | ○ | |
| | 11 | 1.98 | 0.25 | ○ | 0.02 | ○ | ○ | |
| Comparative | 12 | 2.56 | 0.08 | ○ | 0.00 | ○ | ○ | Low-S version of No. 1 |
| Example | 13 | 0.32 | 0.14 | ○ | 0.00 | ○ | ○ | Low-S version of No. 2 |
| | 14 | 0.55 | 0.44 | ○ | 0.20 | X | ○ | High-S version of No. 3 |
| | 15 | 2.67 | 0.72 | ○ | 0.01 | ○ | X | High-C version of No. 4 |
| | 16 | 2.37 | 0.06 | ○ | 0.02 | X | ○ | Low-C |
| | 17 | 0.69 | 1.42 | X | 0.29 | ○ | X | High-C, S version of No. 5 |
| | 18 | 0.07 | 0.14 | X | 0.04 | X | ○ | M < 0.1% |
| | 19 | 5.87 | 0.41 | ○ | 0.06 | ○ | ○ | M > 6% |
| | 20 | 2.73 | 0.15 | ○ | 0.03 | ○ | ○ | Cr < 14% |
| | 21 | 2.84 | 0.19 | ○ | 0.04 | ○ | ○ | Cr > 35% |
| | 22 | 2.88 | 0.35 | ○ | 0.05 | ○ | ○ | Si > 4% |
| | 23 | 3.26 | 0.48 | ○ | 0.08 | ○ | ○ | Mn > 1% |
| | 24 | 3.14 | 0.71 | ○ | 0.15 | ○ | ○ | Al < 0.1% |
| | 25 | 2.85 | 0.16 | ○ | 0.02 | ○ | ○ | Al > 5% |

While a major inclusion in the alloy of the present invention was found to be a compound expressed as (Ti, Zr, Hf)$_4$S$_2$C$_2$ (TICS), some alloys were also found to include (Ti, Zr, Hf)-base sulfide such as (Ti, Zr, Hf)S, or (Ti, Zr, Hf)-base carbide such as (Ti, Zr, Hf)C. There was almost no sign of presence of Ni—S compounds, in particular Ni$_3$S$_2$, in the Ni-base heat-resistant alloy of the present invention.

Such inclusions were identified by the following procedure.

Each round rod was cut to produce a proper amount of test pieces, and the metal matrix thereof was dissolved by an electrolytic process using a methanol solution containing tetramethylammonium chloride and 10% actylacetone as an electrolyte. The electrolytic solution after the solubilization was filtered to thereby extract the insoluble compound contained in the Ni-base alloy. The extracted compound was dried, and was then analyzed by X-ray diffractometry for identification based on observed peaks in the diffraction profile. The composition of the compound grains in the alloy was separately analyzed by EPMA. A two-dimensional mapping based on the EPMA analysis proved formation of a compound having a composition corresponded to that of a compound identified by the X-ray diffractometry.

The individual test pieces were then subjected to each of the following experiments.

1. Machinability Test

Machinability was evaluated based on the amount of wear of the tool when the test piece was cut, and on roughness of the cut surface. A machining tool employed was made of a cemented carbide, with which wet cutting was performed at a peripheral speed of 30 m/min, feed per revolution of 0.2 mm, and depth of cut per revolution of 1.5 mm. The amount of wear of the tool was defined by flank wear on the machining tool after 30 minutes of cutting. Roughness of the cut surface was obtained by measuring arithmetical mean (Ra: μm) of the sample surface after the cutting based on JIS-B0601.

2. Hot Workability Evaluation

A test piece of 6 mm in diameter was cut from the 20-mm-diameter rod, and then subjected to tensile test to thereby evaluate the hot workability. The test was performed using a high-speed tension tester at various temperatures from 900 to 1,250° C., and tensile speed of 50 mm/sec. Defining now the hot workable range as a temperature range in which rupture drawing of not less than 40%, which is a required value for allowing forging, is ensured, the samples having such temperature range of 200° C. or more were assessed as "excellent in hot workability (○)", and those having such temperature range of less than 200° C. were assessed as "poor in hot workability (X)".

3. Hardness Test

C-scale Rockwell hardness of the Ni-base heat-resistant alloy was measured at room temperature according to the Rockwell hardness testing procedures specified in JIS-Z2245.

4. High-Temperature Strength Evaluation

The high-temperature strength was evaluated by carrying out creep rupture test based on the method specified by JIS-Z2272. More specifically, a test piece of 6 mm in diameter was cut from the 20-mm-diameter rod, and then subjected to creep test at 700° C. under a 400-MPa load, and the duration of time before the test piece ruptures was measured.

Experimental results of these tests were shown together in Table 3.

It was made clear from Table 3 that the Ni-base heat-resistant alloy of the present invention in Examples 1 to 11 showed excellent hardness after aging at room temperature and creep characteristics at high temperature ranges, which proved satisfactory characteristics specific to the heat-resistant alloy, and excellent machinability as well. On the contrary, Comparative Examples 12 and 13 showed only poor machinability, which was ascribable to insufficient formation of TICS, which is the machinability improving compound phase, due to an extremely low S content. Comparative Example 14 showed an excellent machinability by the formation of TICS, but was found to be poor in the hot workability due to an excessive S content. Comparative Example 15 showed an excellent creep characteristic at a high temperature range, but was found to be poor in the machinability and hot workability due to an excessive C content. Comparative Example 18 showed only a poor machinability, which was ascribable to insufficient formation of TICS due to an extremely low total contents (M) of (Ti, Zr, Hf), and was found also poor in the hot workability since S cannot be fixed by TICS. Comparative Example 19 showed only a poor hot workability due to excessive M.

It was thus concluded that the Ni-base heat-resistant alloy of the present invention can successfully improve the machinability without ruining the hot workability, while retaining the other characteristics specific to the heat-resistant alloy as comparable to those of the conventional heat-resistant alloys.

What is claimed is:

1. A free-cutting Ni-base heat-resistant alloy containing Ni as a major component;

containing C in an amount of 0.01 to 0.3 wt % and Cr in an amount of 14 to 35 wt %;

containing at least one element selected from Ti, Zr and Hf in a total amount of 0.1 to 6 wt %, and S in an amount of 0.015 to 0.5 wt %;

TABLE 3

| | Cutting Test | | Hot workability Temperature | Hardness after | |
|---|---|---|---|---|---|
| No. | Flank wear (μm) | Roughness of cut surface (μm) | range ensuring 40% or more drawing of 200° C. or above | aging (HRC) | Creep rupture time (hr) |
| 1 | 183 | 3.8 | ○ | 37.8 | 287 |
| 2 | 132 | 3.4 | ○ | 32.3 | 141 |
| 3 | 178 | 3.4 | ○ | 30.1 | 93 |
| 4 | 167 | 3.2 | ○ | 38.4 | 304 |
| 5 | 154 | 3.0 | ○ | 33.0 | 150 |
| 6 | 124 | 3.5 | ○ | 41.6 | 342 |
| 7 | 149 | 3.1 | ○ | 38.2 | 295 |
| 8 | 131 | 3.3 | ○ | 32.5 | 149 |
| 9 | 170 | 3.4 | ○ | 35.3 | 216 |
| 10 | 165 | 3.2 | ○ | 39.1 | 324 |
| 11 | 196 | 3.4 | ○ | 44.9 | 418 |
| 12 | 312 | 8.2 | ○ | 37.4 | 278 |
| 13 | 299 | 7.8 | ○ | 32.1 | 134 |
| 14 | 186 | 3.4 | X | 30.3 | 89 |
| 15 | 238 | 8.4 | X | 37.9 | 298 |
| 16 | 197 | 3.7 | X | 33.2 | 143 |
| 17 | 225 | 4.3 | X | 26.8 | 75 |
| 18 | 257 | 4.6 | X | 30.7 | 97 |
| 19 | 155 | 3.5 | X | 41.6 | 241 |
| 20 | 194 | 3.8 | ○ | 38.9 | 106 |
| 21 | 231 | 5.4 | X | 50.3 | 332 |
| 22 | 189 | 3.9 | X | 40.1 | 223 |
| 23 | 143 | 3.2 | ○ | 39.4 | 188 |
| 24 | 136 | 3.2 | ○ | 20.8 | 44 |
| 25 | 192 | 4 | X | 44.5 | 256 |

having dispersed in the matrix thereof a machinability improving compound phase, said phase containing any one of Ti, Zr and Hf as a major constituent of the metal elements, essentially containing C and either S or Se as a binding component for such metal elements; and satisfying the relations of:

$$W_{Ti}+0.53W_{Zr}+0.27W_{Hf}>2W_C+0.75W_S; \text{ and}$$

$$W_C>0.37W_S$$

where $W_{Ti}$ represents Ti content (wt %), $W_{Zr}$ represents Zr content (wt %), $W_{Hf}$ represents Hf content (wt %), $W_C$ represents C content (wt %) and $W_S$ represents S content (wt %).

2. The free-cutting Ni-base heat-resistant alloy according to claim 1, wherein said machinability improving compound phase mainly comprises a component phase expressed by a composition formula $M_4Q_2C_2$ (where M represents the metal element component containing any one of Ti, Zr and Hf as a major constituent, and Q represents either S or Se).

3. The free-cutting Ni-base heat-resistant alloy according to claim 1 further satisfying a relation of $0.37W_S+0.1>W_C$.

4. The free-cutting Ni-base heat-resistant alloy according to claim 1 further containing Si in an amount of 4 wt % or less and Mn in an amount of 1 wt % or less.

5. The free-cutting Ni-base heat-resistant alloy according to claim 1 further containing Al in an amount of 0.1 to 5 wt %.

6. The free-cutting Ni-base heat-resistant alloy according to claim 1 further containing at least any one of 0.1 to 20 wt % of Co, 0.1 to 20 wt % of Mo and 0.1 to 20 wt % of W.

7. The free-cutting Ni-base heat-resistant alloy according to claim 1 further containing Fe in an amount of 20 wt % or less.

8. The free-cutting Ni-base heat-resistant alloy according to claim 1 further containing Cu in an amount of 0.1 to 5 wt %.

9. The free-cutting Ni-base heat-resistant alloy according to claim 1 further containing Nb and Ta in a total amount of 0.1 to 7 wt %.

10. The free-cutting Ni-base heat-resistant alloy according to claim 1 further containing B in an amount of 0.0005 to 0.01 wt %.

* * * * *